US010490882B2

(12) United States Patent
Mai et al.

(10) Patent No.: US 10,490,882 B2
(45) Date of Patent: Nov. 26, 2019

(54) ANTENNA ASSEMBLY AND MOBILE TERMINAL

(71) Applicants: JianChun Mai, Shenzhen (CN); HuiYing Lu, Shenzhen (CN)

(72) Inventors: JianChun Mai, Shenzhen (CN); HuiYing Lu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 6 days.

(21) Appl. No.: 15/417,116

(22) Filed: Jan. 26, 2017

(65) Prior Publication Data

US 2018/0115069 A1 Apr. 26, 2018

(30) Foreign Application Priority Data

Oct. 25, 2016 (CN) ..... 2016 1 0938166

(51) Int. Cl.

| | |
|---|---|
| ***H01Q 1/24*** | (2006.01) |
| ***H01Q 5/30*** | (2015.01) |
| ***H01Q 9/42*** | (2006.01) |
| ***H01Q 1/22*** | (2006.01) |

(52) U.S. Cl.

CPC ..... *H01Q 1/243* (2013.01); *H01Q 5/30* (2015.01); *H01Q 9/42* (2013.01); *H01Q 1/2291* (2013.01)

(58) Field of Classification Search

CPC ..... H01Q 1/243

See application file for complete search history.

(56) References Cited

U.S. PATENT DOCUMENTS

2009/0153411 A1* 6/2009 Chiang ..... H01Q 1/243 343/702
2014/0184450 A1* 7/2014 Koo ..... H01Q 5/335 343/702
2015/0147984 A1* 5/2015 Ying ..... H04B 1/3827 455/90.3
2017/0331189 A1* 11/2017 Wang ..... H01Q 9/04

* cited by examiner

*Primary Examiner* — Robert Karacsony
(74) *Attorney, Agent, or Firm* — IPro, PLLC; Na Xu

(57) ABSTRACT

The present disclosure provides an antenna assembly, including a metal back cover with a completely closed metal edge frame, and a circuit board provided in the metal back cover, the metal edge frame is provided with a gap along a circumferential direction of the metal edge frame; the circuit board is provided with a matching circuit, a headroom region is provided between the matching circuit and the metal edge frame, the matching circuit includes a grounding point and a feeding point which are electrically connected with the metal edge frame, respectively; the matching circuit and the gap form a three-in-one antenna, which includes GPS antenna, WIFI-2.4G antenna and WIFI-5G antenna, respectively. In the antenna assembly provided by the present disclosure, even the gap is provided on the metal edge frame, the requirements on strength of the metal back cover can also be met, thereby guaranteeing resistance on knocking.

8 Claims, 3 Drawing Sheets

ANTENNA ASSEMBLY AND MOBILE TERMINAL

TECHNICAL FIELD

The present disclosure relates to the field of communication technologies and, in particular, to an antenna assembly and a mobile terminal.

BACKGROUND

With the development of the communication technologies, mobile terminal such as cellphone has become a necessary electronic product in people's life, the consumers have more and more requirements on the functions thereof. In order to satisfy the consumers' requirements, the cellphone generally includes a metal back cover, the metal back cover includes a bottom, the bottom is provided with a gap, the gap extends along a width direction of the cellphone, so as to form an antenna.

However, in such a manner that the gap is provided at the bottom, in order to meet the antenna performance, the length of the gap needs to be relatively large, but the cellphone has a limited width. Therefore, the strength of the metal back cover is reduced, which affects the resistance against knocking.

BRIEF DESCRIPTION OF DRAWINGS

Many aspects of the exemplary embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

REFERENCE SIGNS

10—metal back cover;
11—metal edge frame;
  111—top plate;
  112—side plate;
    1121—bending section;
    1122—straight section;
12—bottom;
20—gap;
30—non-metal piece;
40—headroom region;
50—middle frame;
60—connecting piece;

The drawings herein are incorporated into the description and constitute a part thereof, which show embodiments of the present disclosure and are used to explain principles of the present disclosure together with the description.

DESCRIPTION OF EMBODIMENTS

The present disclosure will be illustrated in further details with reference to the following description and the drawings.

Figure 1:
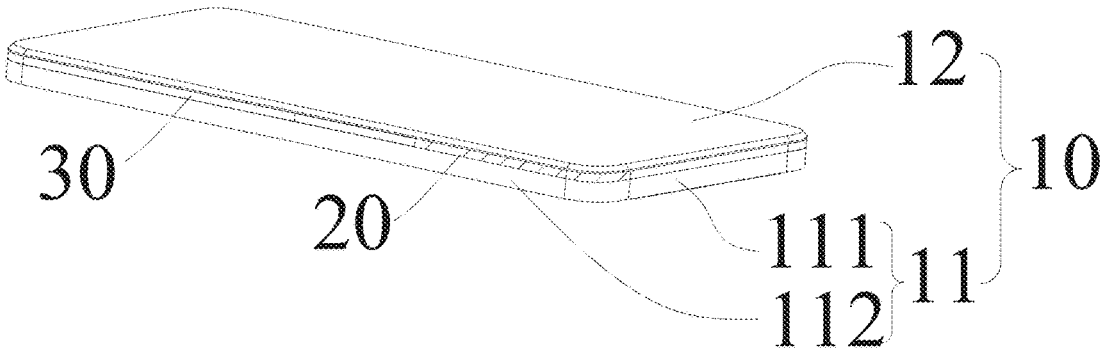
FIG. 1 is a structural schematic view of an antenna assembly in accordance with a specific implementing manner of the prior art.
Figure 2:
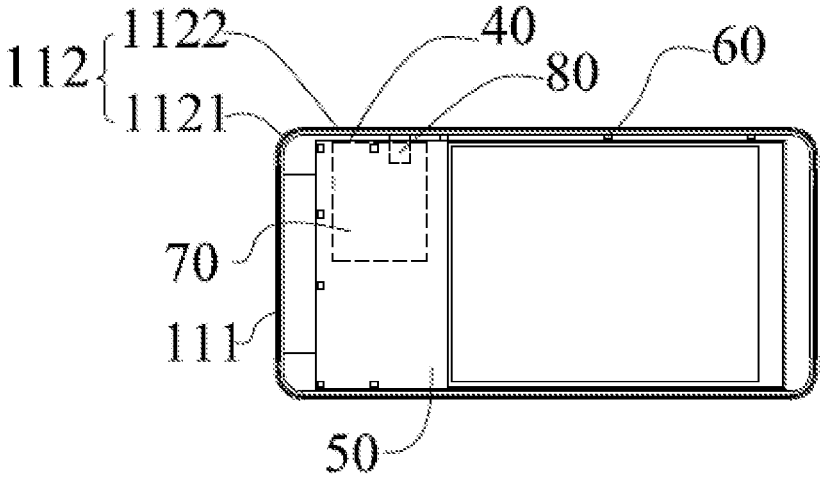
FIG. 2 is a front view of an antenna assembly in accordance with an exemplary embodiment of the present disclosure.

As shown in FIG. 1 and FIG. 2, embodiments of the present disclosure provide an antenna assembly used in a mobile terminal such as cellphone, the antenna can be a three-in-one antenna. The antenna assembly includes a metal back cover 10 with a completely closed metal edge frame 11, and a circuit board (not shown) provided in the metal back cover, the metal edge frame 11 is provided with a gap 20 along a circumferential direction of the metal edge frame 11. The circuit board is provided with a matching circuit 70, a headroom region is provided between the matching circuit 70 and the metal edge frame 11, the matching circuit 70 includes 1 feeding point 80, the feeding point 80 is electrically connected with the metal edge frame 11.

The matching circuit 70 and the gap 20 form a three-in-one antenna, the three-in-one antenna includes a GPS antenna, WIFI-2.4G antenna and a WIFI-5G antenna.

In the above embodiment, the gap 20 is provided on the metal edge frame 11, since the length of the mobile terminal such as cellphone is relatively large, even the side plate 112 is provided with the gap 20, the requirements on strength of the metal back cover 10 can also be met, thereby guaranteeing resistance on knocking. Moreover, the gap 20 is provided on the side plate 112, which can improve appearance of the mobile terminal.

Specifically, the metal edge frame 11 includes a top plate 111 and a side plate 112 bended and extended from an end of the top plate 111, the side plate 112 includes a bending section 1121 and a straight section 1122, as shown in FIG. 2, the top plate 111, the bending section 1121 and the straight section 1122 are successively connected. The gap is formed at the bending section 1121 and the straight section 1122, so as to provide design space of the gap 20. Optionally, the gap 20 can be merely provided at the straight section 1122.

The gap 20 can be formed as follows: 1) the gap 20 is directly provided on the side plate 112; 2) the metal back cover 10 further includes a bottom 12, which is partially connected and partially disconnected with the metal edge frame 11 along a circumferential direction of the metal edge frame 11, a disconnected portion forms the gap 20, that is, the gap 20 is formed through surrounding by the bottom 12 and the side plate 112, such manner can guarantee the connection strength between the bottom 12 and the metal edge frame 11, as well as increasing the strength of the side plate 112.

The headroom region can be formed as follows:

1) directly formed by the circuit board and the side plate 112, the periphery of the circuit board can be spaced with the metal edge frame 11 along the circumferential direction of the metal edge frame 11, so as to form the headroom region 40; or a portion of the periphery of the circuit board can be connected with the metal edge frame 11, another portion thereof can be disconnected with the metal edge frame 11, at least a portion of the disconnected region is opposite to the side plate 112, so as to form the headroom region 40.

2) the headroom region 40 can also be formed by the middle frame 50, as shown in FIG. 2, the antenna assembly further includes a middle frame 50, the middle frame 50 is a metal frame installed in the metal back cover 10, the headroom region 40 is formed between the middle 50 and the metal edge frame 11. Through adding the middle frame 50, the headroom region 40 can be conveniently provided.

The middle frame 50 can be directly connected with the metal back cover 10, that is, directly connected with the bottom 12 or the metal edge frame 11. Optionally, the middle frame 50 is connected with the metal back cover 10 via a connecting piece 60, the connecting piece 60 is provided out of the headroom region 40, as shown in FIG. 2, further, the periphery of the middle frame 50 is spaced with the metal edge frame 11 along the circumferential direction of the metal edge frame 11, so as to form the headroom region 40.

The connecting piece 60 includes a metal portion, that is, the material of the connecting piece 60 can totally be metal material, or only a part thereof is metal material, two ends of the metal portion can respectively connected with the middle frame 50 and the metal back cover 10, so as facilitate the common ground connection of the middle frame 50 and the metal back cover 10. In the present embodiment, the circuit board is generally installed in the middle frame 50. Moreover, there can be a plurality of connecting pieces 60, which are arranged along the circumferential direction of the metal edge frame 11, so as to increase the connection strength between the middle frame 50 and the metal back cover 10.

Since the gap 20 is provided, dust and impurity are easily entered into the metal back cover 10, which affects the antenna performance. Therefore, the antenna assembly further includes a non-metal piece 30, as shown in FIG. 1, the non-metal piece 30 seals the gap 20. Furthermore, the non-metal piece 30 is generally of a ring shape, which fits with the metal edge frame 11. Optionally, the non-metal piece 30 is provided with a ladder surface, the metal edge frame 11 is sleeved on the non-metal piece 30, and is stopped at the ladder surface, so as to increase the strength of the metal back cover 10.

The length of the gap 20 is determined in accordance with the frequency band of the antenna, two ends of the gap 20 are respectively a first end adjacent to the top plate 111 and a second end far away from the top plate 111 along the circumferential direction of the metal edge frame 11.

An effective radiation path of the GPS antenna is a portion from the first end to the second end equivalent to the metal edge frame 11, an electrical length thereof is a half of a working frequency wavelength of the GPS antenna.

An effective radiation path of the WIFI-2.4G antenna is a portion from the feeding point to the second end equivalent to the metal edge frame 11, an electrical length thereof is a half of a working frequency wavelength of the WIFI-2.4G antenna.

An effective radiation path of the WIFI-5G antenna is a portion from the first end to the second end equivalent to the metal edge frame 11, an electrical length thereof is a quarter of a working frequency wavelength of the WIFI-5G antenna.

In the three-to-one antenna, generally, the GPS frequency band is 1560-1590 MHz, WIFI-2.4G frequency band is 2400-2484 MHz, WIFI-5G frequency band is 5150-5850 MHz.

Therefore, the size of the gap 20 along the circumferential direction of the metal edge frame 11 is usually 60 mm, similarly, the size thereof may be larger or smaller than 60 mm due to manufacture and assembly errors.

Figure 3:
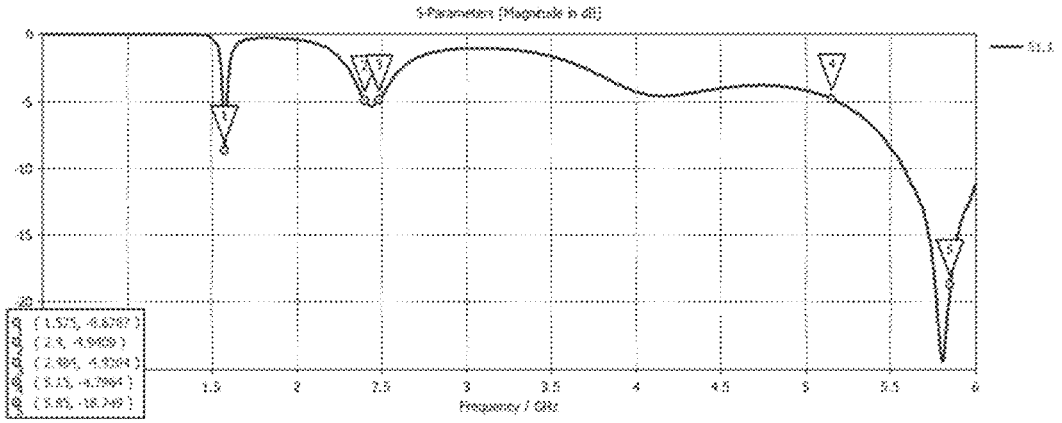
FIG. 3 is a view showing return loss of a three-in-one antenna of the antenna assembly in accordance with the present disclosure.
Figure 4:
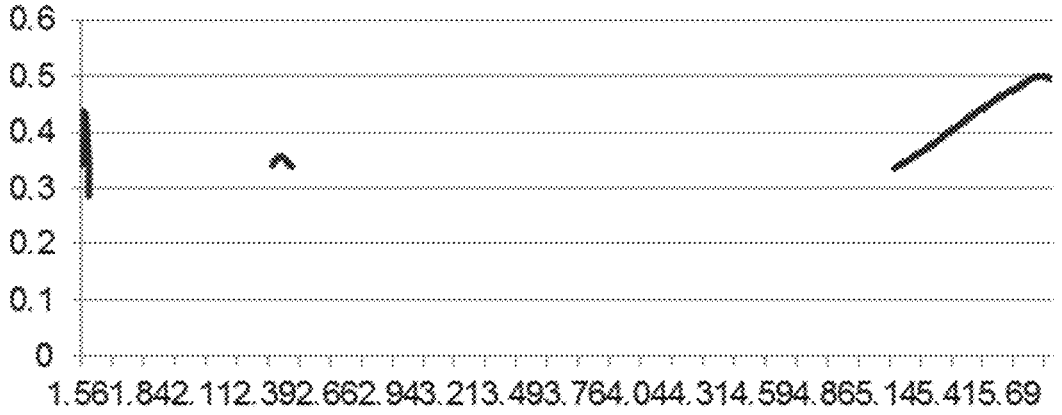
FIG. 4 is a view showing efficiency of a three-in-one antenna of the antenna assembly in accordance with the present disclosure.

As shown in FIG. 3, the transverse axis is frequency, unit is GHz, the longitudinal axis is return loss parameter (S-Parameter), unit is dB; as shown in FIG. 4, the transverse axis is frequency, unit is GHz, the longitudinal axis is efficiency. From FIG. 3 and FIG. 4, the antenna system of the present embodiment sufficiently uses the echo power, which reduces the return loss of the smart wearable device, and thus improves the antenna performance.

If the width of the gap 20 is too large, which will reduce the connection strength between the bottom 12 and the metal edge frame 11, or directly reduces the strength of the metal edge frame 11; however, if the width of the gap 20 is too small, which will degrade the antenna performance. Therefore, a common width of the gap 20 is 1.5-2 mm, for example, 1.5 mm, 1.8 mm, or 2 mm. Specifically, the width of the gap 20 is preferred to be 2 mm. Obviously, due to the manufacture and assembly errors, the size may be larger or smaller than 2 mm. The width is in a direction perpendicular to the circumferential direction of the metal edge frame 11, that is, the width of the gap 20 is a size along a direction perpendicular to the circumferential direction of the metal edge frame 11.

The width of the headroom region 40 is designed in accordance with the size of the mobile terminal and the antenna performance, if the width of the headroom region 40 is too large, which will reduce the connection strength between the middle frame 50 and the metal back cover 10, however, if the width of the headroom region 40 is too small, which will degrade the antenna performance. Therefore, a common width of the headroom region 40 is 1-3 mm, for example 1 mm, 1.5 mm, 2 mm, 2.5 mm, 3 mm. The width is in a direction from the circuit board pointing to the side plate 112, that is, the width of the headroom region 40 refers to the size in a direction from the circuit board pointing to the side plate 112. Specifically, the width of the headroom region 40 of a cellphone is 3 mm, due to the manufacture and assembly errors, the width of the headroom region 40 may be larger or smaller than 3 mm.

The present disclosure further provides a mobile terminal, including the antenna module as described in any one of the above embodiments, wherein the gap 20 is exposed out of the mobile terminal.

The above are merely preferred embodiments of the present disclosure, which are not intended to limit the present invention, for person skilled in the art, the present disclosure can have various alternations and modifications. Any modification, equivalent replacement and improvement made within the spirit and principle of the present disclosure shall fall into the protection scope of the present disclosure.

What is claimed is:

1. An antenna assembly, comprising:

a metal back cover with a completely closed metal edge frame; and a circuit board provided in the metal back cover, wherein the metal edge frame is provided with a gap along a circumferential direction of the metal edge frame, the gap is provided on the metal frame;

the circuit board is provided with a matching circuit, a headroom region is provided between the matching circuit and the metal edge frame, the matching circuit comprises only one feeding point, the feeding point is electrically connected with the metal edge frame;

the matching circuit and the one gap form a three-in-one antenna, the three-in-one antenna includes a global positioning system (GPS) antenna, a wireless fidelity (WIFI)-2.4G antenna and a WIFI-5G antenna;

the metal edge frame comprises a top plate and a side plate bended and extended from an end of the top plate, the side plate comprises a bending section and a straight section, the top plate, the bending section and the straight section are successively connected; the gap is formed at the bending section and the straight section, or provided at the straight section;

two ends of the gap are respectively a first end adjacent to the top plate and a second end far away from the top plate, along a circumferential direction of the metal edge frame, an effective radiation path of the WIFI-2.4G antenna is a portion from the feeding point to the second end equivalent to the metal edge frame, an electrical length thereof is a half of a working frequency wavelength of the WIFI-2.4G antenna.

2. The antenna assembly as described in claim 1, wherein the metal back cover further comprises a bottom, which is partially connected and partially disconnected with the metal edge frame along a circumferential direction of the metal edge frame, a disconnected portion forms the gap.

3. The antenna assembly as described in claim 1, further comprising a middle frame, the middle frame is a metal frame installed in the metal back cover, the headroom region is formed between the middle frame and the metal edge frame.

4. The antenna assembly as described in claim 1, wherein two ends of the gap are respectively a first end adjacent to the top plate and a second end far away from the top plate, along a circumferential direction of the metal edge frame, an effective radiation path of the GPS antenna is a portion from the first end to the second end equivalent to the metal edge frame, an electrical length thereof is a half of a working frequency wavelength of the GPS antenna.

5. The antenna assembly as described in claim 1, wherein two ends of the gap are respectively a first end adjacent to the top plate and a second end far away from the top plate, along a circumferential direction of the metal edge frame, an effective radiation path of the WIFI-5G antenna is a portion from the first end to the second end equivalent to the metal edge frame, an electrical length thereof is a quarter of a working frequency wavelength of the WIFI-5G antenna.

6. The antenna assembly as described in claim 1, wherein a width of the gap is 1.5-2 mm, the width is in a direction perpendicular to a circumferential direction of the metal edge frame.

7. The antenna assembly as described in claim 3, wherein a width of the headroom region is 1-3 mm, the width is in a direction from the middle frame pointing to the metal edge frame.

8. A mobile terminal, comprising the antenna assembly as described in claim 1, wherein the gap is exposed out of the mobile terminal.

* * * * *